US011041278B2

(12) United States Patent
Allen

(10) Patent No.: US 11,041,278 B2
(45) Date of Patent: Jun. 22, 2021

(54) CONNECTION ASSEMBLY

(71) Applicant: Dutchland, Inc., Gap, PA (US)

(72) Inventor: Joshua C. Allen, Lititz, PA (US)

(73) Assignee: Dutchland, Inc., Gap, PA (US)

( * ) Notice: Subject to any disclaimer, the term of this patent is extended or adjusted under 35 U.S.C. 154(b) by 0 days.

(21) Appl. No.: 16/668,553

(22) Filed: Oct. 30, 2019

(65) Prior Publication Data

US 2021/0131048 A1 May 6, 2021

(51) Int. Cl.
*E01D 19/12* (2006.01)
*E04B 1/61* (2006.01)
*E01D 101/24* (2006.01)

(52) U.S. Cl.
CPC ..... *E01D 19/125* (2013.01); *E04B 1/54* (2013.01); *E01D 2101/24* (2013.01)

(58) Field of Classification Search
CPC ..... E01D 19/125; E01D 2101/24; E04B 1/54
USPC ..... 14/73–78
See application file for complete search history.

(56) References Cited

U.S. PATENT DOCUMENTS 3,633,855 A * 1/1972 Nell ..... E01D 19/041 248/694
3,948,008 A 4/1976 Goetz
4,710,994 A * 12/1987 Kishida ..... E01D 2/02 14/6
4,972,537 A * 11/1990 Slaw, Sr. ..... E01D 19/125 14/73
5,025,522 A * 6/1991 Eskew ..... E01D 19/125 14/6
5,457,839 A 10/1995 Csagoly
5,826,290 A * 10/1998 Kokonis ..... E01D 19/125 14/73.1
5,978,997 A * 11/1999 Grossman ..... E01D 2/02 14/73
6,098,357 A 8/2000 Franklin et al.
6,470,524 B1 10/2002 Mairantz
6,902,353 B2 6/2005 Nelson et al.
6,904,636 B2 * 6/2005 Hwang ..... E01D 19/125 14/73
10,106,973 B1 10/2018 Sarda
10,508,434 B2 * 12/2019 Morcous ..... E04B 1/4128
2001/0039773 A1 * 11/2001 Bot ..... E04B 5/38 52/259
2011/0138549 A1 * 6/2011 He ..... E01D 22/00 14/73

(Continued)

FOREIGN PATENT DOCUMENTS

JP 06033469 A 2/1994
JP 96933469 A 2/1994

*Primary Examiner* — Raymond W Addie
(74) *Attorney, Agent, or Firm* — Barley Snyder

(57) ABSTRACT

A connection assembly includes a first concrete member, a second concrete member, and a cap formed of a concrete material. The first concrete member has an end surface and a plurality of reinforcing bars protruding from the end surface. The second concrete member has a plurality of opening walls defining an opening extending through the second concrete member. The second concrete member is disposed on the end surface of the first concrete member with the reinforcing bars disposed in the opening. The cap is cast in the opening around the reinforcing bars and is spaced apart from each of the opening walls.

20 Claims, 2 Drawing Sheets

(56) References Cited

U.S. PATENT DOCUMENTS

2018/0291570 A1* 10/2018 Lee ..... E01D 21/065
2019/0276694 A1* 9/2019 Yamazaki ..... B41J 2/01

* cited by examiner

CONNECTION ASSEMBLY

FIELD OF THE INVENTION

The present invention relates to a connection assembly and, more particularly, to a connection assembly connecting a first concrete member to a second concrete member.

BACKGROUND

In the formation of various concrete structures, adjacent concrete members are attached to each other. In an exemplary orientation, a concrete wall is attached to a concrete walkway positioned on top of the concrete wall. The walkway has an opening and the wall has a portion extending into the opening. The connection between the walkway and the wall is commonly formed by casting a concrete cap around the portion of the wall that is disposed within the opening of the walkway.

The wall and the walkway undergo thermal expansion and contraction over the lifetime of the concrete structure. The concrete cap, however, is cast to fill the opening in the walkway; the concrete material of the concrete cap abuts both the wall and the walkway in a state prior to any expansion or contraction. The thermal expansion and contraction consequently creates stresses in the concrete material of the cap, the wall, and the walkway, which impair the strength of the concrete elements and decrease the useful life of the concrete structure.

SUMMARY

A connection assembly includes a first concrete member, a second concrete member, and a cap formed of a concrete material. The first concrete member has an end surface and a plurality of reinforcing bars protruding from the end surface. The second concrete member has a plurality of opening walls defining an opening extending through the second concrete member. The second concrete member is disposed on the end surface of the first concrete member with the reinforcing bars disposed in the opening. The cap is cast in the opening around the reinforcing bars and is spaced apart from each of the opening walls.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
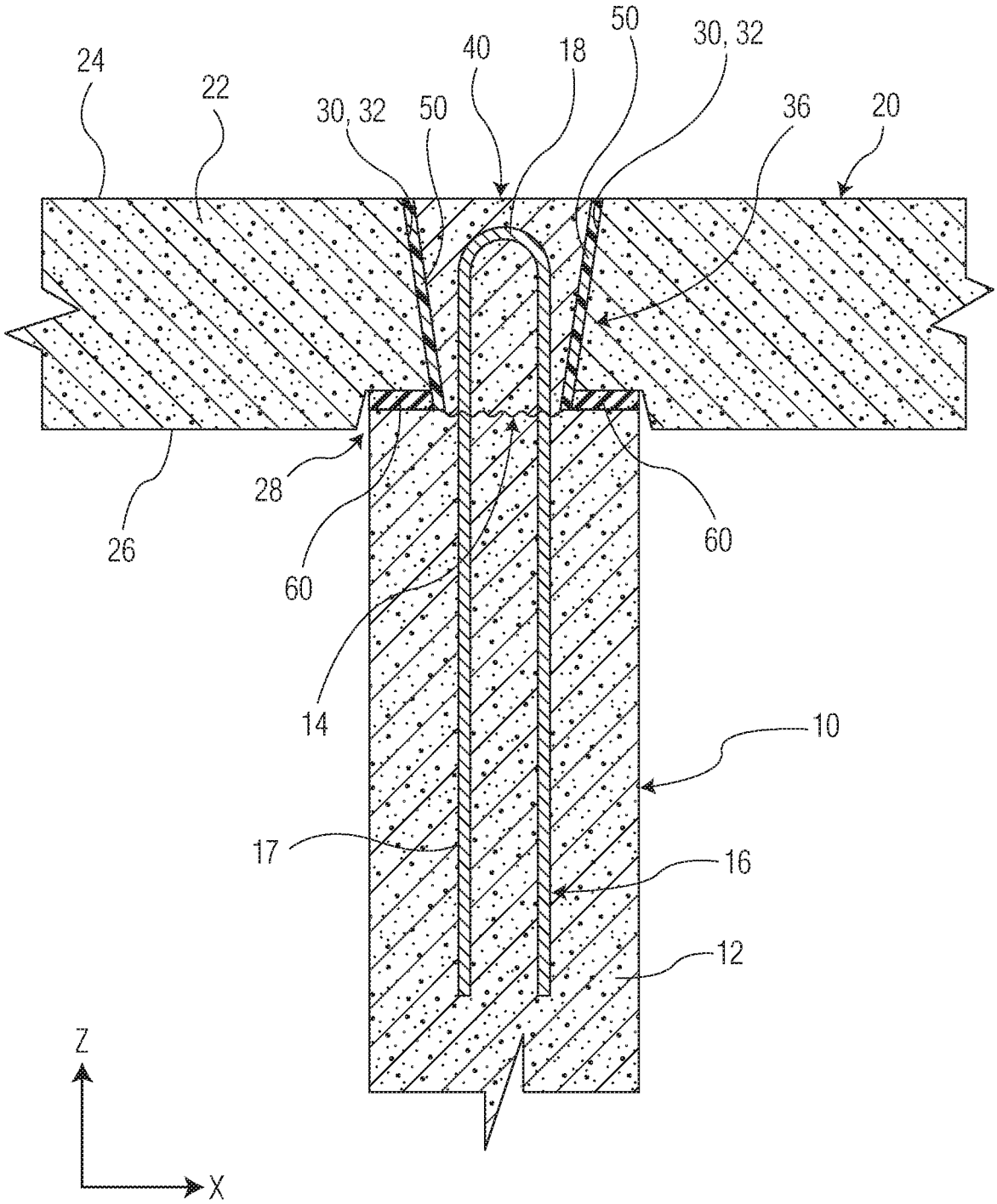
FIG. 1 is a sectional side view of a connection assembly according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will convey the concept of the disclosure to those skilled in the art. In some of the drawings, like reference numerals may be omitted for some of multiple like elements in order to maintain clarity of the drawings.

Figure 2:
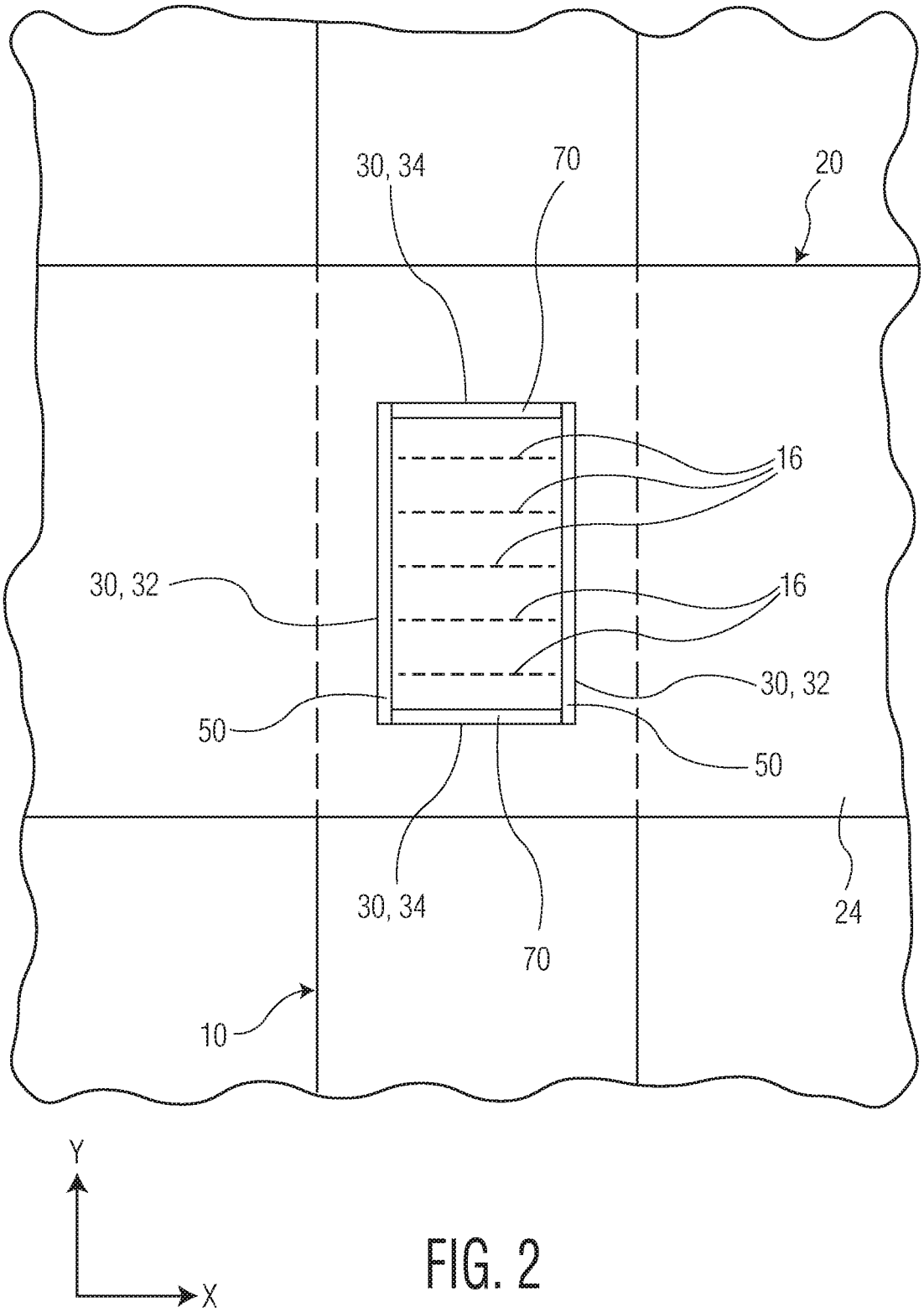
FIG. 2 is a top view of the connection assembly.

A connection assembly according to an embodiment, as shown in FIGS. 1 and 2, comprises a first concrete member 10, a second concrete member 20 disposed on the first concrete member 10, a cap 40 connecting the first concrete member 10 to the second concrete member 20, and a pair of shims 50 disposed between the cap 40 and the second concrete member 20.

The first concrete member 10, as shown in FIGS. 1 and 2, includes a first concrete body 12 and a plurality of reinforcing bars 16 disposed in and protruding from the first concrete body 12. In the shown embodiment, the first concrete member 10 is a precast wall.

The first concrete body 12, in the embodiment shown in FIGS. 1 and 2, is an elongated rectangular member extending along a longitudinal direction Y. The first concrete body 12 has a height extending along a vertical direction Z perpendicular to the longitudinal direction Y and a width extending along a lateral direction X perpendicular to the vertical direction Z and the longitudinal direction Y. As shown in FIG. 1, the first concrete body 12 has an end surface 14 in the vertical direction Z. In the shown embodiment, the end surface 14 is roughened; the end surface 14 is rougher than other surfaces of the first concrete body 12. The first concrete body 12 can be formed of any mixture of cement, water, and aggregate known to those with ordinary skill in the art and used in concrete walls.

As shown in FIG. 1, the reinforcing bars 16 each have an embedded portion 17 disposed within the first concrete body 12 and a protruding portion 18 protruding from the end surface 14 of the first concrete body 12 in the vertical direction Z. In the shown embodiment, each of the reinforcing bars 16 is formed in a U-shape, with a curve of the U-shape forming the protruding portion 18. Although only one reinforcing bar 16 is shown in FIG. 1, the plurality of reinforcing bars 16, as shown each with a dashed line in FIG. 2, are aligned along the length of the first concrete body 12 and spaced at an interval in the longitudinal direction Y. The reinforcing bars 16 may be formed of any material commonly used for reinforcement in precast concrete structures. In an embodiment, the first concrete member 10 is precast prior to being used in the connection assembly, with the reinforcing bars 16 precast within the first concrete body 12 in the arrangement shown in FIG. 1.

The second concrete member 20, as shown in FIGS. 1 and 2, includes a second concrete body 22 and a plurality of opening walls 30 in the second concrete body 22 defining an opening 36 extending through the second concrete body 22 in the vertical direction Z. In the shown embodiment, the second concrete member 20 is a precast walkway.

The second concrete body 22, in the embodiment shown in FIGS. 1 and 2, is an elongated rectangular member extending along the lateral direction X. The second concrete body 22 has a height extending along the vertical direction Z and a width extending along the longitudinal direction Y. The second concrete body 22 has an exterior surface 24 and an interior surface 26 opposite the exterior surface 24 in the vertical direction Z. As shown in the embodiment of FIG. 1, the interior surface 26 has a channel 28 extending along the longitudinal direction Y and centered around the opening 36. The channel 28 is a portion of the second concrete body 22 that has a smaller thickness in the vertical direction Z.

The opening walls 30 of the second concrete body 22, as shown in the embodiment of FIGS. 1 and 2, form an approximately rectangular shape and include a pair of sidewalls 32 disposed opposite one another and a pair of end walls 34 disposed opposite one another and connecting the pair of sidewalls 32. In an embodiment, as shown in FIG. 1, the sidewalls 32 taper in the vertical direction Z; the sidewalls 32 are spaced further apart at the exterior surface 24 than at the interior surface 26. In various embodiments, the end walls 34 can taper in the vertical direction or can extend perpendicularly with respect to the exterior surface 24 and the interior surface 26. The tapering of at least the sidewalls 32 of the opening walls 30 leads to a corresponding tapering of the opening 36 in the vertical direction Z.

As shown in FIGS. 1 and 2, to assemble the connection assembly, the second concrete member 20 is positioned on the end surface 14 of the first concrete member 10 in the vertical direction Z. The end surface 14 is positioned within the channel 28. The protruding portions 18 of the reinforcing bars 16 are positioned to extend into the opening 36 and are approximately centered within the opening 36 between the opening walls 30. As shown in FIG. 1, the protruding portions 18 only protrude partially through the opening 36 in the vertical direction Z and are positioned below the exterior surface 24 in the vertical direction Z.

In the embodiment shown in FIGS. 1 and 2, the first concrete member 10 and the second concrete member 20 have longitudinal extensions that are perpendicular to each other; the first concrete member 10 is elongated along the longitudinal direction Y and the second concrete member 20 is elongated along the lateral direction X. In another embodiment, the first concrete member 10 and the second concrete member 20 may have longitudinal extensions that are parallel to each other. The channel 28, in such an embodiment, may alternatively extend along the lateral direction X to receive the end surface 14 of the first concrete member 10.

In an embodiment, the interior surface 26 of the second concrete member 20, at the channel 28, is positioned to abut the end surface 14 of the first concrete member 10. In another embodiment, as shown in FIG. 1, the connection assembly includes a cap barrier 60 disposed on the end surface 14 of the first concrete member 10. The cap barrier 60 abuts the end surface 14 of the first concrete member 10 and the interior surface 26 of the second concrete member 20 at the channel 28, surrounding the opening 36 at the interior surface 26. In various embodiments, the cap barrier 60 may be a foam tape or a foam pad.

With the second concrete member 20 positioned on the first concrete member 10, as shown in FIGS. 1 and 2, the shims 50 are positioned in the opening 36. Each of the shims 50 is disposed along one of the sidewalls 32 and extends along an entirety of the sidewall 32 between the end walls 34. The shims 50 are each an elongated, approximately rectangular piece sized to fit along the sidewall 32. As shown in FIG. 1, in the vertical direction Z, the shims 50 are each flush with the exterior surface 24 and extend beyond the interior surface 26, abutting the end surface 14 of the first concrete member 10. The shims 50 are each formed of a low friction, concrete bond-breaking material such as a plastic.

In an embodiment, as shown in FIG. 2, the connection assembly includes a pair of compressible members 70 positioned in the opening 36. Each of the compressible members 70 is disposed along one of the end walls 34 and extends along an entirety of a portion of the end walls 34 between the shims 50. The compressible members 70 are each an elongated, approximately rectangular piece sized to fit along the end wall 34; the compressible members 70 each cover an entirety of the end walls 34 in the vertical direction Z. The compressible members 70, in an embodiment, are each formed of an elastomer.

With the second concrete member 20 positioned on the first concrete member 10, and the shims 50 and compressible members 70 positioned along the opening walls 30, the cap 40 is formed in the opening 36 as shown in FIGS. 1 and 2. The cap 40 is a concrete material that can be formed of any mixture of cement, water, and aggregate known to those with ordinary skill in the art. The cap 40 is cast in the opening 36 after the first concrete member 10 and the second concrete member 20 are precast and are positioned in a precast state as described above and shown in FIGS. 1 and 2.

The cap 40, as shown in FIGS. 1 and 2, substantially fills the opening 36 between the shims 50 and the compressible members 70 and is cast around the protruding portions 18 of the reinforcing bars 16. The end surface 14 of the first concrete member 10 is roughened to ensure that the cap 40, when cured, forms a strong bond with the first concrete body 12. The cap barrier 60 limits the spread of the cap 40 while the cap 40 is curing. The cap 40, when cured, is approximately flush with the exterior surface 24. In the shown embodiment, due to the tapering of the sidewalls 32, the cap 40 has a smaller width in the lateral direction X at the end surface 14 of the first concrete member 10 than at the exterior surface 24 of the second concrete member 20.

The shims 50 and the compressible members 70 are disposed between the cap 40 and the second concrete member 20, as shown in FIGS. 1 and 2. In another embodiment, the compressible members 70 are omitted and the space that the compressible members 70 occupy in the shown embodiment is left as an open air. In all embodiments, however, the cured cap 40 is bonded to the first concrete member 10 but is not bonded to the second concrete member 20; the cap 40 is spaced apart from each of the opening walls 30 of the second concrete member 20.

The contact of the cap 40 with the shims 50 and the compressible member 70, or alternatively the open spaces in place of the compressible members 70, permits the cap 40 and the first concrete member 10 connected to the cap 40 to move with respect to the second concrete member 20 during expansion and contraction without stress or damage to the first concrete member 10, the second concrete member 20, or the cap 40.

What is claimed is:

1. A connection assembly, comprising:

a first concrete member having an end surface and a plurality of reinforcing bars protruding from the end surface;

a second concrete member having a plurality of opening walls defining an opening extending through the second concrete member, the second concrete member is disposed on the end surface of the first concrete member with the reinforcing bars disposed in the opening;

a cap formed of a concrete material and cast in the opening around the reinforcing bars, the cap is spaced apart from each of the opening walls; and a pair of shims positioned in the opening between only a portion of the cap and less than all of the opening walls.

2. The connection assembly of claim 1, wherein the opening walls include a pair of sidewalls disposed opposite one another and a pair of end walls disposed opposite one another and connecting the sidewalls.

3. The connection assembly of claim 2, wherein each of the shims is disposed along one of the sidewalls.

4. The connection assembly of claim 3, wherein the shims each extend along an entirety of the sidewalls between the end walls.

5. The connection assembly of claim 1, wherein the shims are each formed of a plastic material.

6. The connection assembly of claim 4, further comprising a pair of compressible members positioned in the opening.

7. The connection assembly of claim 6, wherein each of the compressible members is disposed along one of the end walls.

8. The connection assembly of claim 7, wherein the compressible members each extend along an entirety of a portion of the end walls between the shims.

9. The connection assembly of claim 1, wherein the first concrete member is a precast wall and the second concrete member is a precast walkway.

10. The connection assembly of claim 1, wherein the cap is cast in the opening with the first concrete member and the second concrete member in a precast state.

11. The connection assembly of claim 2, wherein the second concrete member has an exterior surface and an interior surface opposite the exterior surface, the opening walls extend from the exterior surface to the interior surface.

12. The connection assembly of claim 11, wherein the sidewalls taper and are spaced further apart at the exterior surface than at the interior surface.

13. The connection assembly of claim 11, wherein the interior surface has a channel centered around the opening.

14. The connection assembly of claim 13, wherein the end surface of the first concrete member is positioned in the channel.

15. The connection assembly of claim 11, further comprising a cap barrier disposed between the end surface of the first concrete member and the interior surface of the second concrete member, the cap barrier surrounding the opening at the interior surface.

16. The connection assembly of claim 15, wherein the cap barrier is a foam tape or a foam pad.

17. The connection assembly of claim 11, wherein the cap is bonded to the end surface of the first concrete member.

18. The connection assembly of claim 17, wherein the end surface is roughened.

19. The connection assembly of claim 17, wherein the cap has a smaller width at the end surface of the first concrete member than at the exterior surface of the second concrete member.

20. The connection assembly of claim 6, wherein the shims are positioned between the cap and the opening walls only along a lateral direction and the compressible members are positioned between the cap and the openings walls only along a longitudinal direction perpendicular to the lateral direction.

* * * * *